United States Patent [19]

Gabbay et al.

[11] 4,250,425

[45] Feb. 10, 1981

[54] ROTATING ANODE X-RAY TUBE FOR TOMODENSITOMETERS

[75] Inventors: Emile Gabbay; Dang Tran Quand; André Lafitte, all of Paris, France

[73] Assignee: Compagnie Generale de Radiologie, Paris, France

[21] Appl. No.: 5,689

[22] Filed: Jan. 23, 1979

[30] Foreign Application Priority Data

Jan. 27, 1978 [FR] France ..... 78 02340

[51] Int. Cl.[3] ..... H01J 35/10; H01J 35/04

[52] U.S. Cl. ..... 313/60; 250/445 T; 313/459

[58] Field of Search ..... 313/60, 55, 459

[56] References Cited

U.S. PATENT DOCUMENTS

| | | | |
|---|---|---|---|
| 3,983,397 | 9/1976 | Albert | 313/60 X |
| 4,045,672 | 8/1977 | Watanabe | 250/445 T |

OTHER PUBLICATIONS

Heritage et al., "Electron Gun for Generating X-rays," IBM Technical Disclosure Bulletin; vol. 17, No. 6; Nov. 1974; p. 1823.

*Primary Examiner*—Robert Segal

*Attorney, Agent, or Firm*—Roland Plottel

[57] ABSTRACT

A hollow, cylindrical, rotating anode, X-ray tube for tomodensitometers.

This tube contains a bell-shaped, hollow, cylindrical anode functioning by transmission, which is swept on its inner surface by an electron beam and produces in co-operation with a collimation device having several openings a series of fine X-ray beams, which are roughly parallel and coplanar, the number of these beams being equal to the number of openings in the collimation device. Such a tube makes very fast tomography possible.

6 Claims, 1 Drawing Figure

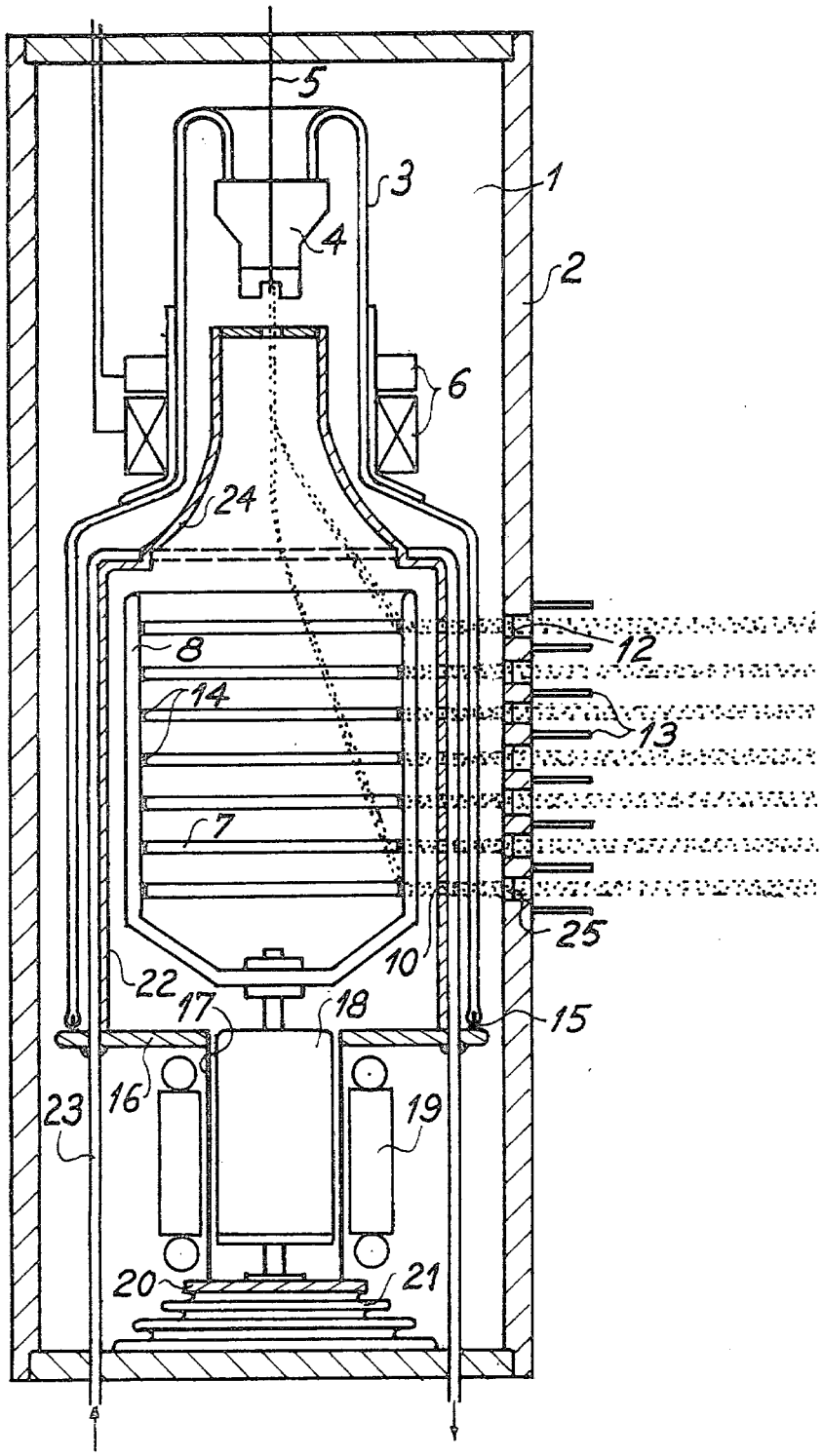
5
3
1
4
2
6
24
12
8
14
13
7
25
10
22
17
18
15
16
23
19
20
21

ROTATING ANODE X-RAY TUBE FOR TOMODENSITOMETERS

The present invention covers a rotating anode X-ray tube intended more especially for a transverse axial tomography apparatus using a computer which is also called a tomodensitometer.

Originally, apparatuses of this type contained a source which emitted a fine ray of penetrating radiation in the direction of the section of the body to be examined and a detector arranged in such a way as to receive this radiation and measure its intensity after it passed through the body. The source-detector assembly was subjected to a rectilinear movement perpendicular to the direction of the beam and then to a small angular rotation (about 1°) around an axis perpendicular to the examination plane and so on until the whole assembly had turned about 180°. Very long examination times were the result. These were troublesome for the patient and it was not possible to examine moving organs.

To correct this disadvantages apparatuses were designed in which the rectilinear sweep movements were suppressed. The source emitted a fan-shaped beam of radiation with a wide aperture in the section plane which passed through the body and irradiated simultaneously several detectors placed side by side in this plane. The source-detector assembly is then only subjected to a rotational movement round the body. Such an apparatus is described for example in British Pat. No. 1 430 089 which is a division of the application filed on May the 17$^{th}$ 1972 under No. 23 064/72 by E.M.I. Limited.

An intermediate solution, described for example in French patent application No. 74.29537, published under No. 2 242 835 for the same company, consists in using a radiation source emitting a fan-shapes beam, with a smaller aperture than in the preceding case and a smaller number of detectors which are subjected to rectilinear movements and angular rotations equal to the beam aperture angle.

Still with the intention of reducing the examination time, in the case in which the rectilinear movement of the source is retained, suppression of the mechanical sweep has been considered with the use of an X-ray tube as radiation source which has an anode of elongated shape arranged in the direction of the rectilinear movement and swept by an electron beam so that the focal point, from which the fan-shaped beam is emitted, makes the lateral sweep movement with respect to the body. As in the case of the aforementioned British patent, a row of fixed detectors is arranged, sufficient in number to pick up all the rays emitted by the source during its movement. Such an apparatus is described for example in German Pat. No. P 25 38 517.5 filed by E.M.I. Limited.

Finally, to reduce or cut out the mechanical rotation of the source-detector assembly round the object to be examined, X-ray tubes were designed whose anode in the shape of an arc of a circle or a ring surrounds the object partly or completely. These tubes contain either a fixed cathode whose electron beam is deviated to sweep the anode (as described for example in French patent application No. 76.27368, published under No. 2 324 191, filed by NIHON DENSHI KABUSHIKI KAISHA) or a moving cathode mounted on a trolley (as described in French patent application No. 76.31251, published under No. 2 328 280 for E.M.I. Limited) or several fixed cathodes whose deviated beams sweep a corresponding part of the anode (as also described in the French patent application published under No. 2 328 280).

All these known apparatuses have common disadvantages in that they use fan-shaped radiation beams. Processing of the data supplied by the detectors for the construction of the image representing the distribution of the radiation absorption in the plane of the section is examined is longer and more complicated than in the case in which the attenuation values of parallel radiation beams can be obtained directly irrespective of whether these data are recombined in groups or not corresponding to paths of parallel beams.

X-ray tubes with a fixed or rotating anode used in these apparatuses produce fan-shaped beams inside which the energy distribution varies widely. Also, the projection of the real focal point on the input surface of each of the detectors suffers distortion which increases with the angular deviation with respect to the centre ray of the beam and the detectors at the ends of the row receive only a small part of the radiated energy.

Also, in an apparatus using a fan-shaped beam, all the detectors or several of them are irradiated simultaneously so that a detector may pick up diffused rays belonging originally to beams associated with other detectors in spite of the existence of the collimation device placed in front of these detectors and this results in noise at the image level.

The invention covers a rotating anode X-ray tube which enables the disadvantages mentioned above and others to be eliminated. It enables the mechanical linear sweep movement to be reduced and even eliminated in the case of objects of relatively small size (skull, breast).

With the X-ray tube in accordance with the invention a series of coplanar, separate parallel beams are produced which improves the spatial resolution of the apparatus (detection of sudden big density variations in the object); the beam intensity is sufficient not to affect the density resolution (differentiation of very similar densities) and, also, the beams are highly directional, which reduces the undesirable influence of the beam aperture existing in known apparatuses and making it necessary to introduce corrections at the calculation level thus increasing the data acquisition and/or calculation time.

In accordance with the invention, the X-ray tube contains:

a hollow cylindrical rotating anode functioning by transmission and having a support in the shape of a hollow cylindrical bell of material which absorbs little the X-rays emitted by a thin target of refractory material which emits the X-rays and is deposited on the internal cylindrical surface of this support, a collimation device with several openings placed in front of the anode, the target of the said anode being swept, under the action of a deviation system, by a beam of electrons emitted by a cathode so as to produce in cooperation with the collimation device a series of fine X-ray beams, which are roughly parallel and coplanar, the number of these beams being equal to the number of openings in the collimation device.

Other advantages and characteristics will appear from the following description which is given as a non-limiting example and is illustrated by the FIGURE in the appendix which shows an axial section of a rotating anode X-ray tube in accordance with the invention.

This tube (1) has a leaded sheath (2). The tube envelope has a part 3 of glass surrounding the cathode 4 and anode 7. The glass is sealed at 15 to a metallic plate 16. This plate has an opening in which is fixed a metallic cylinder 17 surrounding the anode rotor 18 and around the cylinder is arranged the stator 19. This cylinder is sealed at its lower end by a disc 20, which is fixed on an insulating block 21 which is itself fixed to leaded sheath 2.

Anode 7 is bell-shaped and can be made of graphite or aluminium for example. The thickness of the cylindrical part, which forms the substrate 8 on whose inner surface is deposited a target emitting X-rays, may be 4 to 5 mm when graphite is used and 2 mm when aluminium is used.

This target is formed by a thin, X-ray emitting layer, between 2 and 10μ thick. It is of refractory material with a high atomic number, tungsten or platinum for example; this layer is deposited by a known method, electronic bombardment, electrolytic deposition, deposition in the vapour phase, on substrate 8.

It can cover all the inner surface of the cylindrical part or be deposited in the form of annular strips 14 which are concentric with the anode rotational axis by using a suitable mask.

The tube also has a cylindrical shaped enclosuire 22 between the anode and envelope which may be made of a metal such as copper or tantalum. This enclosure is fixed on plate 16 and has openings 10 to pass the X-rays. In the case of a target of annular strips the said openings 10 are opposite the strips 14. Apart from acting as collimator, this enclosure absorbs interference radiation (radiation out of focus, diffused radiation) and also absorbs the thermal radiation emitted by the anode by transmitting the heat to a fluid cooling circuit which is shown schematically at 23 and surrounds the said enclosure. The X-ray tube also has a focussing device 24 between the anode and cathode which is rigidly connected to the enclosure and whose purpose is to focus the electron beam emitted by the cathode and produce a homogeneous field in the space between the cathode and anode.

Deviation of the electron beam for the purpose of sweeping the target is obtained with an electromagnetic or electrostatic system 6. Anode 7, metallic parts 16, 17, 20 and 21, enclosure 22 and focussing device 24 are at the same potential.

The sheath has openings 25 corresponding to the openings in collimation device 10, which allow the X-rays to pass and are sealed by aluminium windows.

On the outside of the sheath are fixed parallel strips 13 which act as a second collimation device and are made of a material which absorbs X-rays.

The present invention is in no way limited to the model described and shown. Many variants are accessible to the professional depending on the applications proposed and without going outside the field of the invention.

For example, anode 7 can be swept simultaneously by several electron beams to obtain several parallel X-ray beams at once. The examination time is thus divided by the number of beams. In order to retain the advantage concerning diffused radiation, a sufficient spacing between electron beams must be used. A wider electron beam may also be used to give several nearby X-ray beams simultaneously.

What is claimed is:

1. An X-ray tube, for tomodensitometers in particular, containing:

a hallow, cylindrical rotating anode (7) functioning by transmission, with a support in the shape of a hollow cylindrical bell of material which absorbs little the X-rays emitted by a thin target of refractory material, which emits the X-rays and is deposited on the internal cylindrical surface of this support (8), a collimation device (10) with several openings placed in front of the anode, the target of the said anode being swept, under the action of a deviation system (6), by a beam of electrons emitted by a cathode (4) so as to produce in cooperation with the collimation device a series of fine X-ray beams, which are roughly parallel and coplanar, the number of these beams being equal to the number of openings in the collimation device.

2. An X-ray tube as claimed in claim 1, wherein the refractory material forming the target is deposited on the whole of the inner surface to the cylindrical bell-shaped support (8).

3. An X-ray tube as claimed in claim 1, wherein the refractory material forming the target is deposited in the form of separate annular strips (14) arranged concentrically with respect to the axis of the cylindrical bell-shaped support (8), in planes perpendicular to the direction of the electron beam sweep, and opposite the openings of the collimation device (10).

4. An X-ray tube as claimed in claim 1, wherein the collimation device has a cylindrical metallic enclosure (22) placed inside the tube and around the anode (7) containing openings (10) which leave a path for the X-ray beams.

5. An X-ray tube as claimed in claim 2 or 3, wherein the thickness of the target is between 2 and 10μ.

6. A tomodensitometer containing one or several X-ray tubes as claimed in claim 1.

* * * * *